United States Patent [19]

Berentzem

[11] 4,417,454

[45] Nov. 29, 1983

[54] NEEDLE FOR KNITTING MACHINES AND METHOD FOR MAKING SAME

[75] Inventor: Hardo Berentzem, Albstadt, Fed. Rep. of Germany

[73] Assignees: Theodor Groz & Sohne; Ernst Becker & Nadelfabrik Commandit-Gesellschaft, both of Albstadt, Fed. Rep. of Germany

[21] Appl. No.: 373,520

[22] Filed: Apr. 30, 1982

Related U.S. Application Data

[63] Continuation-in-part of Ser. No. 126,046, Feb. 29, 1980, abandoned.

[30] Foreign Application Priority Data

Mar. 22, 1979 [DE] Fed. Rep. of Germany ..... 2911195

[51] Int. Cl.[3] ..... D04B 35/02

[52] U.S. Cl. ..... 66/123

[58] Field of Search ..... 66/123

[56] References Cited

U.S. PATENT DOCUMENTS 546,986 10/1895 Adgate ..... 66/123

3,748,875 7/1973 Slof et al. ..... 66/123

FOREIGN PATENT DOCUMENTS 2123971 12/1971 Fed. Rep. of Germany ..... 66/123

1327453 6/1961 France ..... 66/123

*Primary Examiner*—Ronald Feldbaum

*Attorney, Agent, or Firm*—Allison C. Collard; Thomas M. Galgano

[57] ABSTRACT

A needle for a knitting machine comprising a needle shank having a needle foot thereon which has a substantially rectangular cross section and at least one longitudinal groove formed in one side face thereof. The invention also relates to a method for producing such a needle.

5 Claims, 5 Drawing Figures

NEEDLE FOR KNITTING MACHINES AND METHOD FOR MAKING SAME

This is a continuation-in-part of application Ser. No. 126,046, filed on Feb. 29, 1980, now abandoned.

The invention relates to a knitting needle for knitting machines to be used in a circular or a flat knitting machine and to a method for preparing such needles for knitting machines.

In the state of the art, various needles are known which are stamped or punched out from sheet metal having an elongated needle shaft with a needle hook on one end and a needle foot which extends transversely to the longitudinal axis of the needle shaft and projects from its upper edge. When making such needles, needle blanks are stamped or punched out from sheet metal strips. These blanks are then transformed into the final needle by means of finishing and polishing operations. Thereby, the front faces of the needle feet are rounded off, chamfered or bevelled around the edges, so as to reduce the wear of the needle feet and the flanks of the cam groove of the knitting machine by which the needles are displaced in the needle channels or slots of the needle bed. This finishing of the needle foot is especially required with the increased operating speed of today's knitting machines. In order to obtain an exact positive positioning of the needle, each needle foot must be exactly guided between the opposite flanks or guide faces of the cam groove. This means that only a very small play is available between the front faces of the needle feet and the adjacent flanks of the cam groove.

In order to facilitate the movement of the needles in the needle channels and to reduce the friction between the front faces of the needle feet and the flanks of the cam groove, an oil lubrication is required. In order to be effective, the oil which, in particular, is distributed over the walls of the needle channels must also be brought to the engaging faces between the highly stressed front faces of the needle feet and the flanks of the cam groove. The side faces of the feet of conventionally stamped needles for knitting machines are smooth and even. Therefore, they cannot influence the distribution of the lubricating oil and cannot feed any oil into the cam grooves.

Circular knitting machines with a needle cylinder diameter of 30", which usually operate at a maximum of about 15 rotations per minute, today run up to 28 rotations per minute. Due to this high number of rotations, the needles are subjected to very high accelerations with the undesired result that shock waves are generated in the needles, which propagate in the longitudinal direction thereof. The shock waves travel from the impact location of the flanks of the cam groove to the front faces of the needle feet which are in contact therewith. Recent tests have shown that they are the cause of very serious needle hook damage.

As already mentioned above, the feet of needles for knitting machines must be very smooth at their front faces. When the needles of the knitting machines are punched out of sheet metal, the front faces of the feet which extend normally with respect to the longitudinally direction of the needle shank are provided with a punching or stamping fracture which must be removed. The solution for this problem is made more difficult by the fact that the punching fracture varies due to the wear of the punching tools and the condition of the different materials of the strip steel.

It is known (see German Offenlegungsschrift No. 26 37 078) to round off, chamfer or bevel the needle foot front faces on their edges by means of a punching or stamping operation. For this purpose, the needle foot is at first punched out of the strip of steel with an exaggerated width, so as to be able to compensate for all irregularities which are present at the punching fracture. Remaining pieces of the exaggerated width of the needle foot must be subsequently removed by machining. Therefore, the advantages of a non-machining operation are again eliminated.

The invention provides a needle for a knitting machine which is provided with at least one longitudinally-extending elongated groove in one side face of the needle foot which extends in a direction from the upper edge of the needle shank to the upper edge of the needle foot. This groove in at least one side face of the needle foot brings additional lubricating oil from the needle channels or slots of the needle bed into the cam groove, so that the prevailing lubricating conditions on the flanks of the cam groove and the engaging front faces of the needle feet are improved. In addition, such a groove also reduces the propagation of shock waves, for example, which are caused by the high acceleration of such needles in circular knitting machines. Therefore, needle feet with a groove at their side face have shock absorbing characteristics and are especially suitable for rapid running circular knitting machines.

The grooves in the side face(s) of the needle feet cam be stamped or punched into the material of the needle feet. In this manner a machining operation becomes superfluous.

In addition, the invention also provides a method for operating such a needle foot of a needle of a knitting machine. In this method, a needle with a unitary or integrally-formed blank of a needle foot is punched out, with the needle foot being smaller than the finished or desired needle foot, and with the needle foot being left with its punching fracture and its associated indentations and serrations. Subsequently, the needle foot blank is inserted between two stationary shaping or die faces for a corresponding rounding off, chamfering or bevelling, in such a manner that each of the shaping faces is disposed opposite one of the side faces of the needle foot blank with the distance between the stationary shaping faces corresponding with a close tolerance to the exact required width of the needle foot. Thereafter, at least one groove is punched into at least one side face of the blank of the needle foot, and the material is displaced toward the front faces of the needle foot so that it closely or snugly engages with the opposite stationary shaping faces. In this manner, indentations (defects) or serrations which are caused by the punching fracture during the punching operation can be completely compensated at the front faces of the needle foot, while the needle foot blank is transformed into the exact shape of the needle foot. Thereby, the material in the area of the front faces is also compacted. Since the front faces are the parts of the needle foot which are primarily subjected to the highest stresses during the acceleration of the needle, the compacted material in the area of the smooth, exactly calibrated front faces of the needle foot is highly advantageous. It results in a reduction of the wear of the needle feet and the flanks of the cam grooves, so that the quality of the needles and the efficiency of the knitting machines provided with such needles are substantially improved.

In addition, this method of forming the needle feet requires less time and, in any case, less time than would be required for a machining operation. Finally, the accumulation of turnings are eliminated which is very advantageous when mass producing needles for knitting machines.

It is therefore an object of the invention to provide novel needles for knitting machines with an increased life span for rapidly moving knitting machines, whereby the needle feet of the needles and the cam grooves of the knitting machine are subjected to a reduced wear, relative to the known needles for knitting machines, so that the efficiency of the knitting machine is increased.

A further object of the invention is to provide a novel stamped or punched needle for a knitting machine punched out of band material with a needle foot, whose front faces have improved wear characteristics than known needles of knitting machines.

Finally, it is an object of the invention to provide a method wherein the needle foot front faces or parts obtain their final shape totally and exclusively by means of a non-machining operation.

Further objects and features of the invention can be seen from the following detailed description considered in connection with the accompanying drawings, which disclose several embodiments of the invention. However, it is to be understood that the drawings are to be used for the purposes of illustration only, and not as a definition of the limits of the invention.

In the drawings, wherein similar reference characters denote similar elements throughout the several views.

Figure 1:
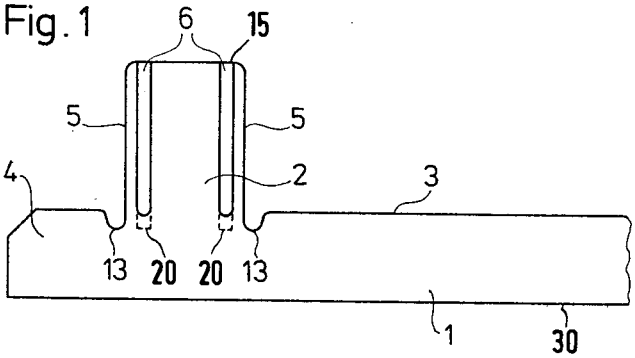
FIG. 1 is an enlarged side view of a foot end of a needle for knitting machines in accordance with the invention.
Figure 2:
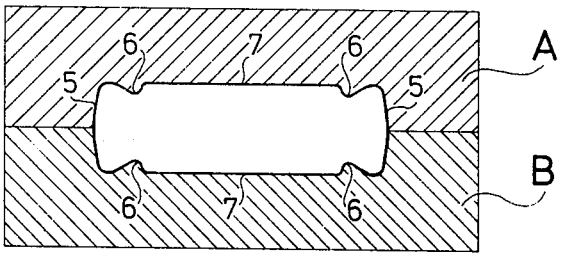
FIG. 2 is a further enlarged plan view of the needle foot showing FIG. 1 within a punch mold.
Figure 5:
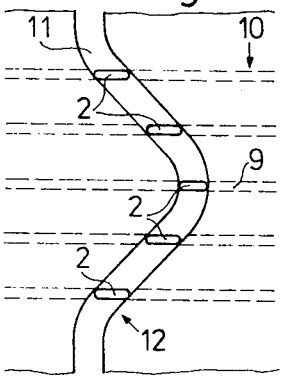
FIG. 5 is a plan view showing the needle foot in five different stations of the needle lock.

Referring now in detail to the drawing, the foot end of a needle is shown in FIG. 1. In particular, FIG. 1 illustrates a side view of an end portion 1 of a needle shank having an upper edge 3 and a lower edge 30. End portion 1 includes a finished punched foot 2 having a substantially rectangular cross-sectional shape which projects upwardly from the needle shank upper edge 3 transversely relative to the longitudinal direction of the needle shank 1 and has an upper edge 15. While the needle shank 1 is provided with a so-called follow up guide 4, the main guidance of the needle shank 1 in the knitting machine is carried out by the elongated, longitudinally-extending grooves 9 of the needle bed 10, as can be seen in FIG. 5. Foot 2 projects from the elongated grooves 9 and extends into the cam groove 11 of the needle lock 12 of the knitting machine. As can be seen, the needle feet front faces 5 come into engagement with the oppositely-disposed flanks of the cam groove 11.

Figure 3:
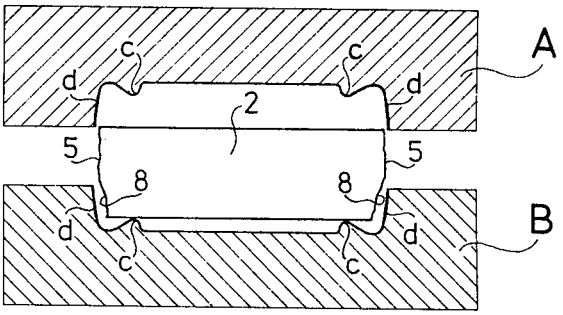
FIG. 3 is a view comparable to FIG. 2, but showing an open punch mold with a needle foot in its blank state, before the punching operation.

The needle is stamped or punched out of a steel strip. In the resulting blank, the front faces 5 of the needle foot which are disposed normally with respect to the longitudinal axis of the needle shank 1 have a punching fracture 8, as can be seen in FIG. 3. In order to remove the punching fracture, the needle foot 2 is inserted between two punch mold halves A and B, when they are opened in accordance with FIG. 3. On both needle foot longitudinal sides 7, the punching mold halves have punching dies C which can generate grooves into the needle foot 2 in the form of elongated, longitudinally-extending grooves 6 which extend approximately parallel to each other and at about the same distance from the associated front faces 5. When forming the extended grooves, material is displaced toward the front faces. The displaced material is pushed closely against the adjacent punch die walls D.

As can be seen from FIG. 1, the elongated grooves 6 extend from the upper edge 15 of the needle foot 2 to the upper edge 3 of the needle shank 1. Advantageously, the needle shank merges into the needle foot via grooves 13.

Figure 4:
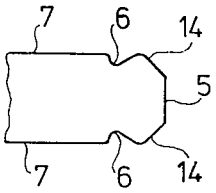
FIG. 4 is a plan view of a needle foot having bevelled edges.

Instead of rounding off the edges of the needle foot front faces 5, they may be provided with bevels 14, as can be seen in FIG. 4.

In an alternative embodiment, the grooves 6 extend to a location 20 below the height of the upper edge 3 of the needle shank 1 and about the alignment height of the grooves 13, as can be seen in FIG. 1 by means of the dash lines. Thereby, after the placing of the needles into the needle bed 10, the grooves 6 of the needle foot 2 extend into the longitudinally-extending grooves 9 of the needle bed 10, so that distributed oil is moved over the flanks of the grooves 9. This oil is then moved to the cam groove 11, wherein it improves the prevailing lubrication conditions.

While only several embodiments of the present invention have been illustrated and described, it is obvious that many changes and modifications cam be made thereunto without departing from the spirit and scope of the invention.

What is claimed is:

1. In a knitting machine needle of the type having a flat elongated, longitudinally-extending shank having an upper and lower edge and an integrally-formed foot which extends generally transversely to the longitudinal axis of said needle shank and projects above its upper edge, said foot having a generally rectangular cross sectional shape and two opposite side faces and two opposite front faces, the improvement comprising:

an elongated, longitudinally-extending groove in at least one of the side faces of said foot extending in a direction from the upper edge of said needle shank to the upper edge of said needle foot.

2. The knitting machine needle of claim 1, wherein said groove is punched into said side face.

3. The knitting machine needle of claim 2, wherein said groove is disposed adjacent to one of said front faces.

4. The knitting machine needle of claim 2, wherein said elongated groove extends from said upper edge of said needle foot to said upper edge of said needle shank.

5. The knitting machine needle of claim 2, wherein said needle shank has at least one needle shank groove formed therein adjacent to the base of said needle foot and wherein said elongated groove extends from the upper edge of said needle foot to a point below said upper edge of said needle shank, which is in alignment with the base of said needle shank groove.

* * * * *